US005980399A

United States Patent [19]

Campbell et al.

[11] Patent Number: 5,980,399

[45] Date of Patent: Nov. 9, 1999

[54] BALL TOSS APPARATUS

[75] Inventors: Douglas B. Campbell, Loretto; Jeffrey J. Campbell, Lonsdale, both of Minn.

[73] Assignee: Volleyball Products International, Inc., Loretto, Minn.

[21] Appl. No.: 08/906,737

[22] Filed: Aug. 6, 1997

[51] Int. Cl.[6] ..... A63B 69/00

[52] U.S. Cl. ..... 473/459; 124/61; 124/72

[58] Field of Search ..... 473/459, 451; 463/56; 434/247; 124/51.1, 54, 55, 73, 6, 16, 61, 77, 75, 72; 273/397

[56] References Cited

U.S. PATENT DOCUMENTS

| | | | |
|---|---|---|---|
| 3,345,977 | 10/1967 | Hall | 124/77 |
| 3,400,703 | 9/1968 | Rhoder | 124/75 |
| 4,345,577 | 8/1982 | Andersson | 124/16 |
| 4,424,972 | 1/1984 | Vinette | 273/397 |
| 4,770,153 | 9/1988 | Edelman | 124/72 |
| 4,784,107 | 11/1988 | Kelly | 124/61 |
| 5,195,744 | 3/1993 | Kapp | 473/451 |
| 5,676,120 | 10/1997 | Joseph | 124/6 |
| 5,727,538 | 3/1998 | Ellis | 124/77 |

*Primary Examiner*—Sam Rimell
*Attorney, Agent, or Firm*—Kinney & Lange, P.A.

[57] ABSTRACT

A ball toss apparatus for tossing a ball is disclosed. The ball toss apparatus includes an air compressor for compressing air. An air storage tank is connected to the air compressor for storing the compressed air. A pressure regulator is connected to the air storage tank for regulating the pressure of the compressed air contained in the air storage tank. A pneumatic air cylinder is connected to the air storage tank via a three-way solenoid actuated valve for receiving the compressed air. A ball launch arm is connected to the pneumatic cylinder for launching the ball.

18 Claims, 7 Drawing Sheets

BALL TOSS APPARATUS

BACKGROUND OF THE INVENTION

The present invention is an apparatus for tossing a ball. More particularly, the present invention is a free standing device which can launch a series of volleyballs spaced in time to replicate numerous volleyball situations including a serve, a pass, a set or a hit in a volleyball environment.

The sport of volleyball has become one of the fastest growing participation sports in the United States, as well as in the entire world. More people play organized volleyball at the present time than at any other time in the past. Volleyball leagues and tournaments are held both throughout the United States and throughout the world. In addition, indoor volleyball has been an Olympic sport for several years, and beach volleyball made its Olympic debut in the 1996 Olympics in Atlanta, Ga.

There are a variety of different types of volleyball leagues and tournaments. In particular, there are women's leagues and tournaments, men's leagues and tournaments, and co-ed leagues and tournaments. In each of these categories, volleyball games can be played indoors on a hard court surface, or outdoors on either a grass surface or sand surface. In addition, the number of players per team can vary anywhere from two to six players playing for one team at any given time.

Due to the increasing popularity of the sport of volleyball, most colleges and universities have both men's and women's varsity and/or club volleyball teams which compete against other college or university teams similar to the sport of basketball. Likewise, a majority of all high schools in the United States offer volleyball as a varsity sport for both boys and girls. In addition to the college and high school arena, there is also an official governing body in the United States which governs both boys and girls volleyball activities during the off-season and mens and womens volleyball activities throughout the year. This governing body is called the United States Volleyball Association. The United States Volleyball Association offers tournaments throughout the off-season for boys and girls ranging from ages 10–18 in their junior Olympic program. The Unites States Volleyball Association also governs men's and women's volleyball leagues and tournaments throughout the United States. Presently, there are over 2,000 adult men and women volleyball teams and over 5,000 junior Olympic volleyball teams registered with the United States Volleyball Association. Finally, in addition to both men's and women's professional beach leagues and tournaments, a womens professional indoor league has begun and a mens professional indoor league is slated to begin before the year 2000.

With the increasing popularity of volleyball in the United States, as well as the rest of the world, more and more players are becoming members of teams which practice regularly. During any given practice it is often desireous to practice various volleyball skills such as passing a served ball, setting a passed ball hitting a set ball or blocking a hit ball. Presently, a coach or an extra player is necessary to continuously serve or feed (toss) volleyballs to the practicing team. However, often times there is not an extra player to perform this task. In addition, consistency in the toss is very important. Without consistency, it is difficult to practice a particular skill. Finally, an individual player may want to practice a variety of volleyball skills such as passing a served ball, setting a passed ball, hitting a set ball or blocking a hit ball at a time when no other persons are present. Without the aid of additional personal to serve, pass, set or hit the volleyball, this player cannot replicate a game situation.

Therefore, there is a need for a machine which can provide the repetitive function of consistently serving, passing or setting a plurality of volleyballs to a player such that the player can practice one or more volleyball skills.

BRIEF SUMMARY OF THE INVENTION

The present invention is a ball toss apparatus for tossing a ball. More particularly, the present invention is a device for launching a volleyball, thereby replicating numerous volleyball situations including a serve, a pass, a set or a hit in a volleyball environment. The ball toss apparatus comprises an air compressor connected to an energy source. An air storage tank is connected to the air compressor for storing compressed air. A pressure switch regulates the pressure of the compressed air contained in the air storage tank. A pneumatic air cylinder is connected to the air storage tank via a three-way solenoid actuated valve. A launch arm is connected to the pneumatic air cylinder for launching the ball.

In one preferred embodiment, the ball toss apparatus further includes a circuit board and a computer processing unit for controlling the launch of the ball. The ball toss apparatus also includes a ball feeder for permitting a plurality of balls to be continuously positioned above the ball launch arm. The ball feeder further comprises a plurality of elements including a ball track feeder for containing the plurality of balls, a ball feeder mechanism for holding a ball adjacent to the ball launch arm and for permitting a ball to be positioned on the ball launch arm, a second pneumatic air cylinder, a second pressure regulator and a second three-way solenoid actuated valve which together control the ball feeder mechanism.

In another preferred embodiment, the ball toss apparatus further includes a control panel having an on/off power switch, a mode switch, height and timer adjustment knobs, height and timer displays, and a battery life indicator display.

In another preferred embodiment, the ball toss apparatus further includes a remote control transmitter and remote control receiver for transmitting and receiving a launch signal, an optical sensor for detecting the presence of a ball positioned above the launch arm, a shock absorbing mechanism for minimizing vibration of the ball toss apparatus during a launch, a pre-launch buzzer and a pre-launch light emitting diode for providing an audible and a visual signal prior to the launch of the ball, an angle adjustment mechanism for adjusting an angle of the ball toss apparatus, and a timer for permitting a ball launch after a predetermined length of time.

DETAILED DESCRIPTION OF THE PREFERRED EMBODIMENTS

The present invention is a ball toss apparatus. In particular, the present invention is a free-standing portable device which can launch volleyballs to replicate numerous volleyball situations including a serve, a pass, a set or a hit in a volleyball environment. This serve/pass/set/hit replication can facilitate a variety of volleyball drills, or can permit an individual to practice passing a served ball, setting a passed ball, hitting a set ball or blocking a hit ball without the aid of other individuals. In addition, the present invention permits a volleyball coach or trainer to watch and coach the player performing the intended drill, rather than focusing attention on the individual feeding the volleyballs to begin the particular drill.

Figure 1:
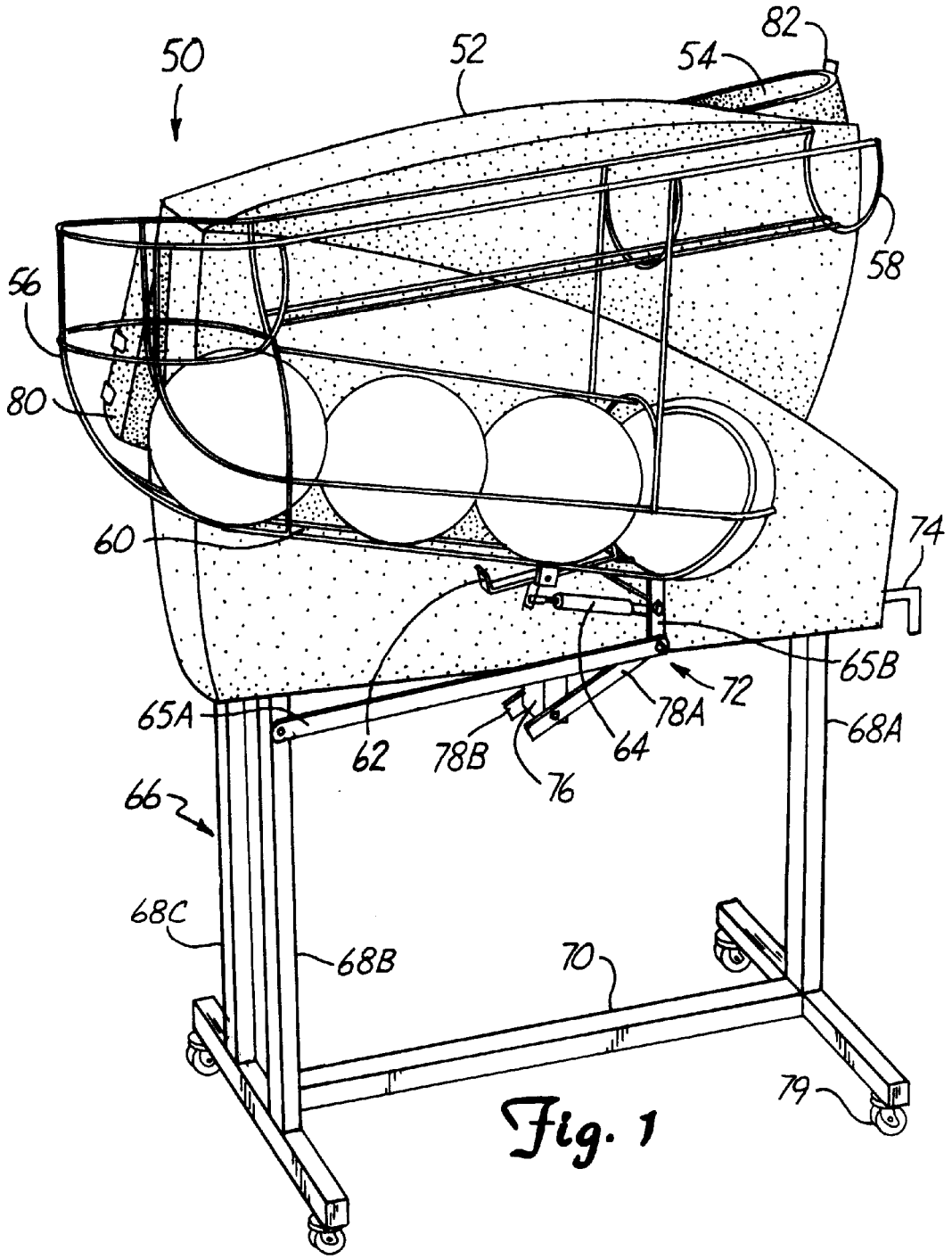
FIG. 1 is an overall exterior view in perspective of a ball toss apparatus.

FIG. 1 is an overall exterior view in perspective of ball toss apparatus 50. Ball toss apparatus 50 includes housing 52 having opening 54; ball track feeder 56 comprising first or upper ball container rail 58, second or lower ball container rail 60, ball feeder mechanism 62 and pneumatic air cylinder 64; ball track feeder leveling mechanism 65A–B; stand 66 having legs 68A, 68B and 68C and base 70; angle adjustment mechanism 72 which includes crank 74, bar 76 and braces 78A–B; wheels 79; control panel 80; and pre-launch light 82. While FIG. 1 shows ball track feeder 56 having upper and lower rails 58 and 60, it is understood that two connecting racks are not a critical feature. Rather, a single rail can be used.

Figure 2A:
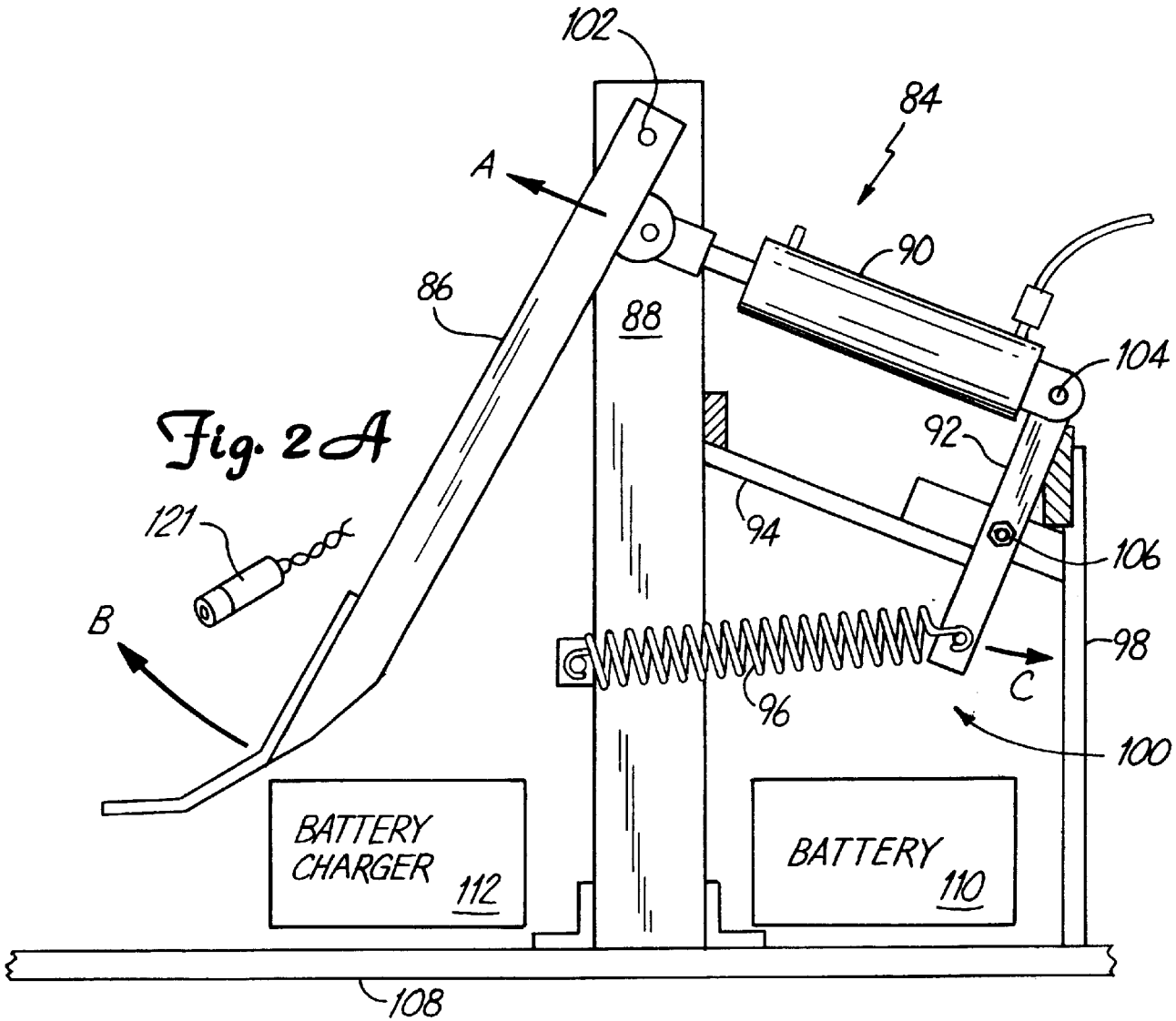
FIG. 2A is a side view opposite the ball track feeder showing the launch arm of the present invention prior to the launch of a ball.
Figure 2B:
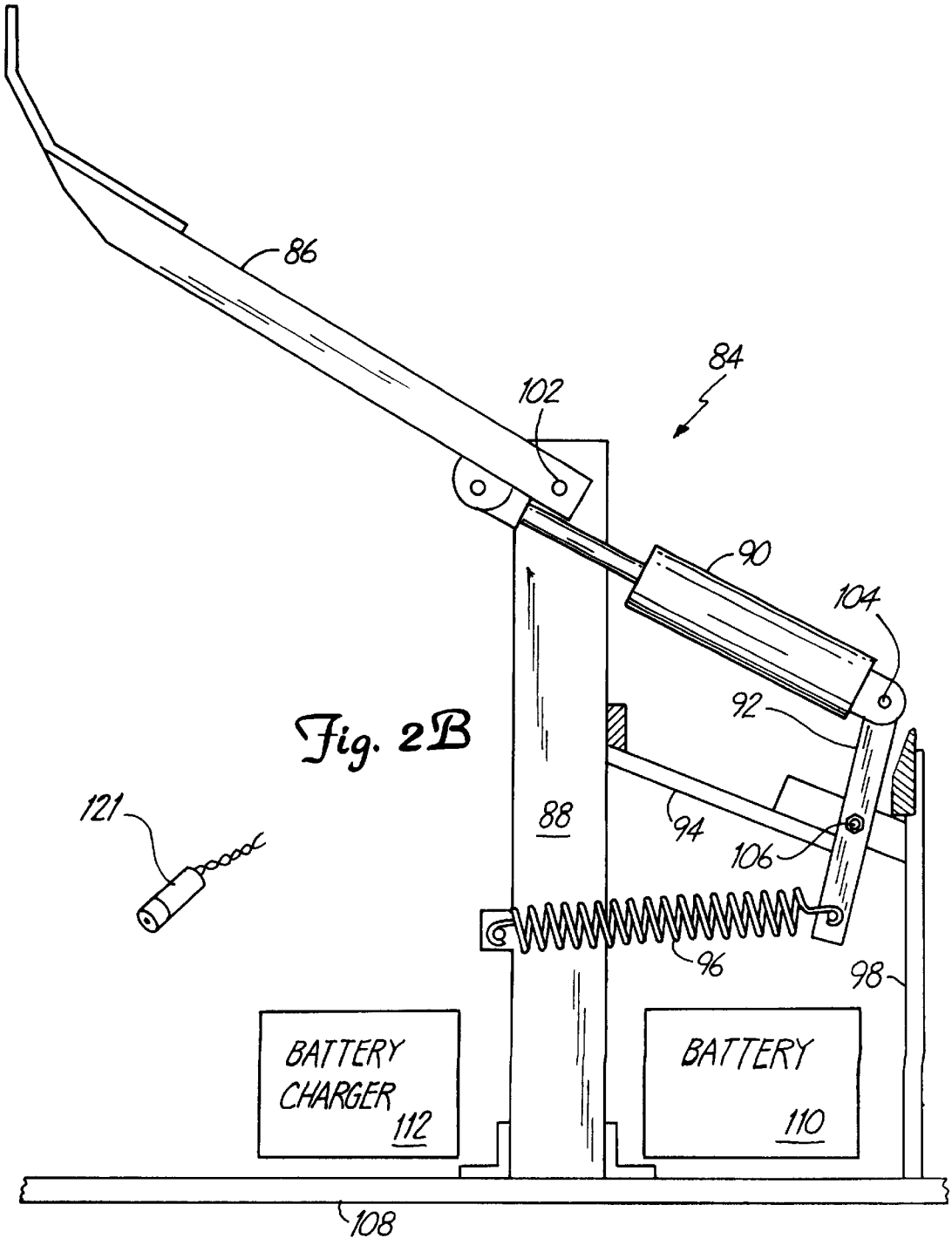
FIG. 2B is a side view opposite the ball track feeder showing the launch arm of the present invention after the launch of a ball.
Figure 5:
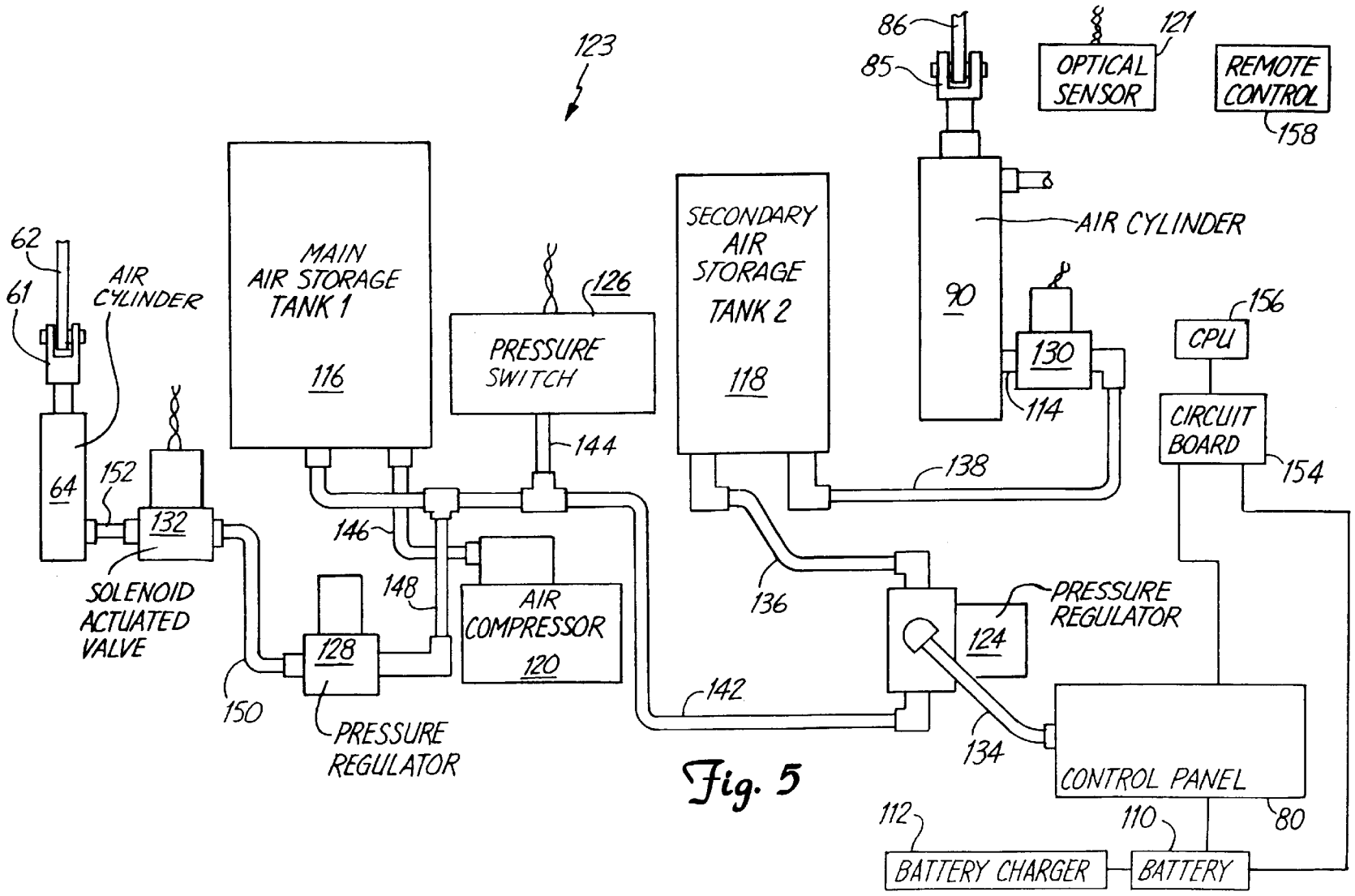
FIG. 5 is a system diagram of the present invention.

Ball toss apparatus 50 can be used during a volleyball practice, or can be used by an individual at any time, to practice various volleyball skills such as passing a volleyball, setting a volleyball, attacking (hitting/spiking) a volleyball or blocking a volleyball. In operation, various control features can be set via control panel 80. As shown in FIGS. 2A, 2B and 5, ball toss apparatus 50 is powered by battery 110 which is a 12 volt battery. In addition, battery charger 112 can continuously charge battery 110. Control panel 80 will further be described later in this application with reference to FIG. 6.

The angle of housing 52 can be set to a desired angle through use of angle adjustment mechanism 72. In particular, crank 74 can be used to adjust the angle of housing 52 with respect to base 70 via bar 76, which is attached to bottom panel 108 (shown in FIGS. 2A and 2B) of housing 52 and through use of braces 78A–B. Ball track feeder leveling mechanism 65A–B maintains ball track feeder 56 at a proper level and angle such that volleyballs will properly feed into housing 52 due to gravity.

A single launch or a series of launches can be completed. Prior to each launch, pre-launch light 82 will repeatedly flash to inform the player that the ball is about to be launched. In addition, ball toss apparatus 50 can produce an audial buzzer via CPU 156 (shown in FIG. 5) prior to each launch. As mentioned earlier, ball toss apparatus 50 can simulate either a serve, a pass, a set or a hit of a volleyball.

After a launch of a volleyball, CPU 156 activates solenoid actuated three-way valve 132 (shown in FIG. 5) to provide 10 to 50 psi of air to pneumatic air cylinder 64 which will move from right to left as viewed in FIG. 1. This will cause ball feeder mechanism 62 to rotate in the range of approximately 15 to 90 degrees in a clockwise direction via the pivot in the center of ball feeder mechanism 62. The volleyball positioned on ball feeder mechanism 62 will then be permitted to enter housing 52 and come to rest just above launch arm 86 (shown in FIGS. 2A–4) while a second volleyball will be prevented from rolling down second ball container rail 60. Ball feeder mechanism 62 will then rotate in the range of approximately 15 to 90 degrees in a counterclockwise direction, back to the base position shown in FIG. 1, thereby permitting the second volleyball to come to rest on ball feeder mechanism 62.

FIGS. 2A and 2B are side views opposite of ball track feeder 56 showing launch apparatus 84 having launch arm 86 positioned before and after a launch of a volleyball, respectively. As shown in FIGS. 2A and 2B, launch apparatus 84 includes launch arm 86, bar 88, pneumatic air cylinder 90 having air intake 91A and air outlet 91B, braces 92 and 94, spring 96, bar 98, pivots 102, 104 and 106, bottom plate 108 and optical sensor 121. Brace 92, spring 96 and pivots 104 and 106 make up shock absorbing mechanism 100. Compressed air enters pneumatic air cylinder 90 from secondary or launch storage tank 118 via intake 91A and exits pneumatic air cylinder 90 via outlet 91B during a launch.

Also shown in FIGS. 2A and 2B are battery 110 and battery charger 112. Battery 110 can be any size as long as it provides enough power to properly run all elements of ball toss apparatus 50. In one preferred embodiment, battery 110 is a 12 volt direct current (DC) battery. Batter charger 112 is used to continuously charge battery 110 and in one preferred embodiment is a 6 amp battery charger.

During a launch of a volleyball, optical sensor 121 would confirm that a volleyball is positioned above launch arm 86. Pneumatic air cylinder 90 would be actuated by computer processing unit 156 (shown in FIG. 5). A piston within pneumatic air cylinder 90 will force the air from right to left as viewed in FIGS. 2 and 3, thereby actuating launch arm 86. The actuation of pneumatic cylinder 90 would force launch arm 86 to move in the direction of arrows A and B (See FIG. 2A). Likewise, brace 92 would move in the direction as shown by arrow C (See FIG. 2A). Pneumatic air cylinder 90 will provide a substantial force to launch arm 86 such that launch arm 86 moves in the direction as shown by arrows A and B at an extremely high rate of speed. Likewise, brace 92 will also be rotated in the direction as shown by arrow C. Therefore, as shown in FIG. 2B, once launch arm 86 is fully extended, spring 96, in conjunction with brace 92 and pivots 104 and 106, will absorb a majority of the shock and vibration, thereby preventing vibration of ball toss apparatus 50.

Figure 3:
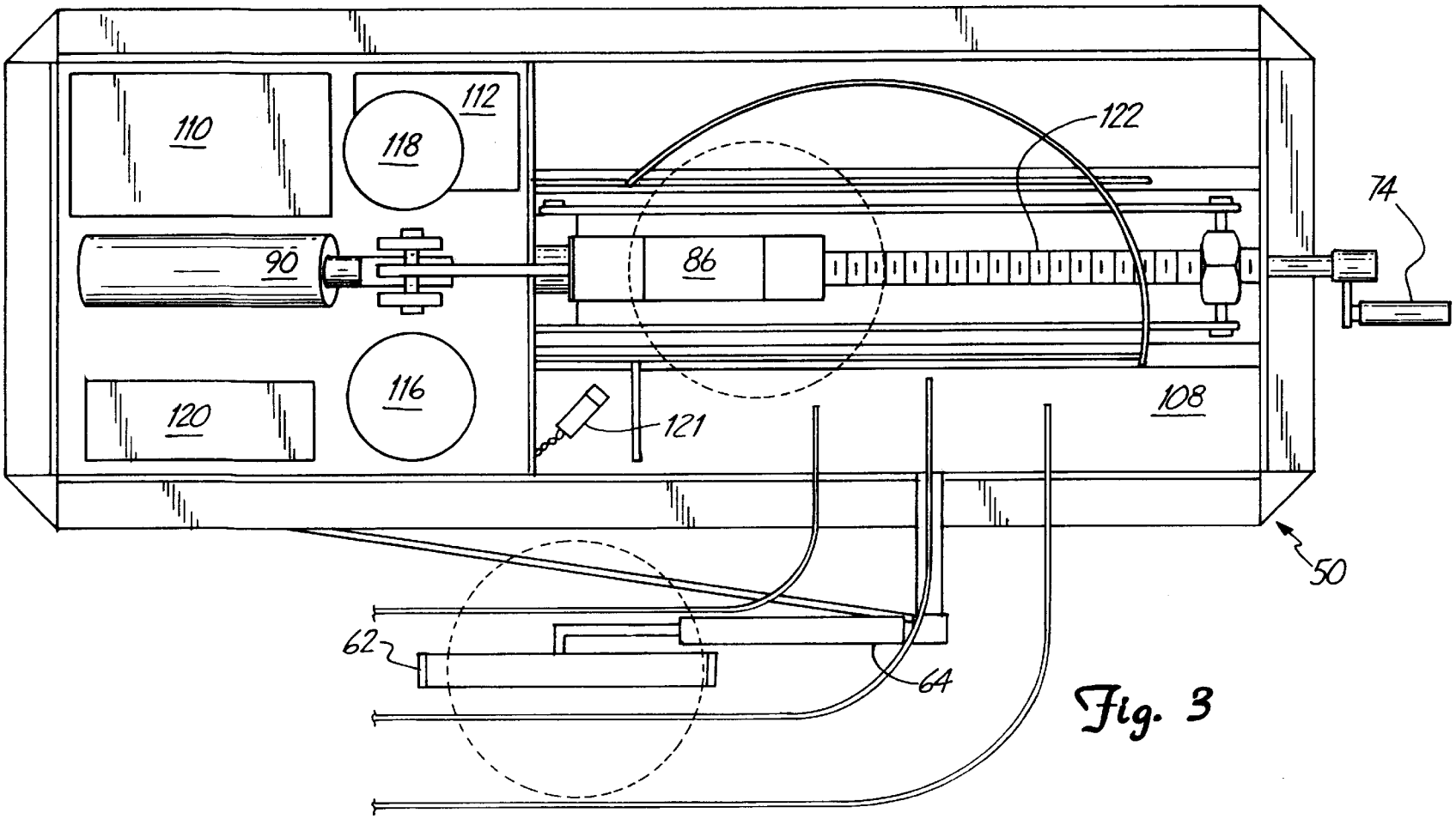
FIG. 3 is a top view of the present invention with the housing removed.

FIG. 3 is a top view of ball toss apparatus 50 having housing 52 removed. As shown in FIG. 3, ball toss apparatus 50 includes second or lower ball container rail 60, ball feeder mechanism 62, pneumatic air cylinder 64, crank 74, launch arm 86, pneumatic air cylinder 90, bottom plate 108, optical sensor 121, battery 110, battery charger 112, main storage tank 116, secondary storage tank 118, air compressor 120, and ACME rod 122. Two separate volleyballs are shown in phantom, one above launch arm 86 and one on second ball container rail 60, held in position by ball feeder mechanism 62.

FIG. 3 shows the path of a volleyball prior to launch traveling from second ball container rail 60 to launch arm 86. Ball feeder mechanism 62 prevents a volleyball from entering the main housing (not shown in FIG. 3) and from being positioned on launch arm 86 until pneumatic air cylinder 64 is activated. Once pneumatic air cylinder 64 is activated, ball feeder mechanism 62 is rotated as previously discussed and the volleyball is permitted to roll down second ball container rail 60 to be properly positioned just above launch arm 86. A launch sequence can then be initiated.

Figure 4:
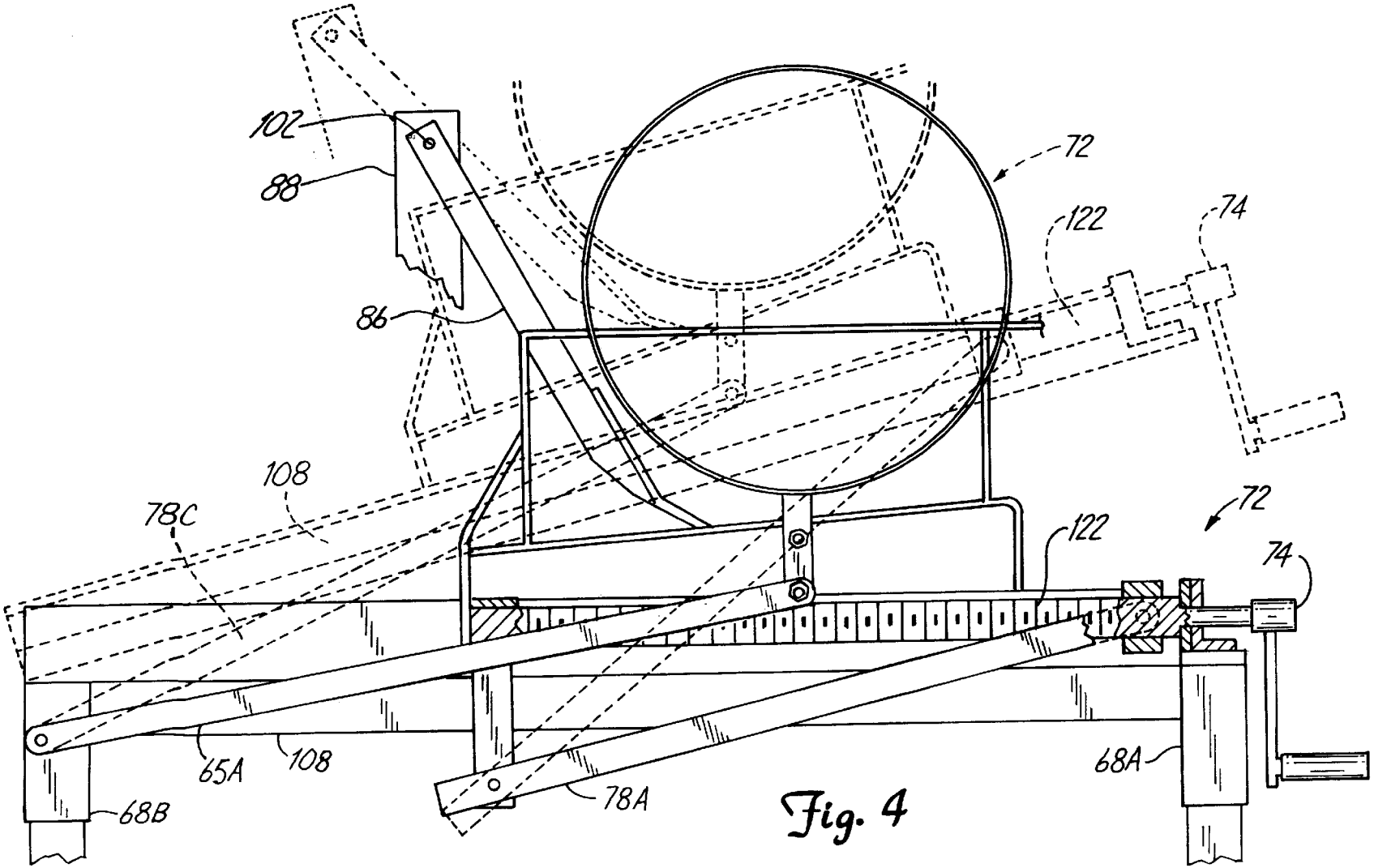
FIG. 4 is a detail of the angle adjustment mechanism of the present invention.

FIG. 4 is a detailed view of angle adjustment mechanism 72 of the present invention. Angle adjustment mechanism 72 can vary the position of the elements within housing 52 from a first lower position shown in solid lines, to a second raised position shown in phantom. Adjusting the angle at which a ball will be launched is important in that an individual may want ball toss apparatus 50 to replicate a serve or a high set or may want apparatus 50 to replicate a "quick" set, a "shoot" set or a hit. Angle adjustment mechanism 72 permits numerous and various replications. Clearly, with angle adjustment mechanism 72 set in a lower position, a volleyball will be directly above ball toss apparatus 50. Conversely, with angle adjustment mechanism 72 set in a high position, a volleyball will be launched further away from ball toss apparatus 50.

FIG. 5 is a system diagram used in the present device. As shown in FIG. 5, system 123 includes clevis 61, ball feeder mechanism 62, pneumatic air cylinder 64, control panel 80, clevis 85 launch arm 86, pneumatic air cylinder 90, optical sensor 121, battery 110, battery charger 112, connector 114, main air storage tank 116, secondary air storage tank 118, air compressor 120, pressure regulators 124 and 128, pressure switch 126, three-way solenoid actuated valves 130 and 132, connection hoses 134–152, circuit board 154, computer processing unit (CPU) 156 and remote control transmitter 158. While CPU 156 is shown in FIG. 5 separate from circuit board 154, it is understood that CPU 156 is actually positioned on circuit board 154.

Figure 6:
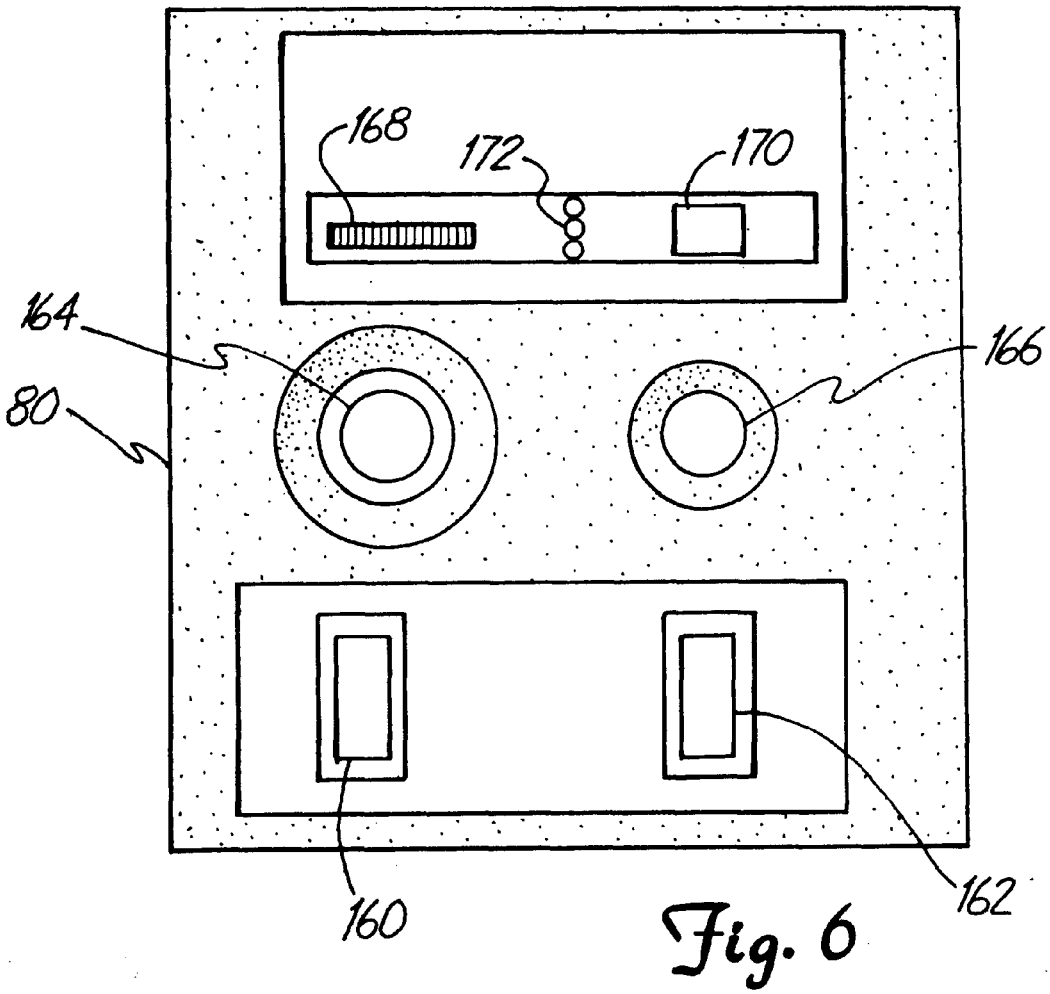
FIG. 6 is a front view of the control panel of the present invention.

As shown in FIG. 5, the details of control panel 80 are not shown. However, FIG. 6 is a front view of control panel 80. As shown in FIG. 6, control panel 80 includes power switch 160, mode switch 162, height adjustment knob 164, timer adjustment knob 166, height adjustment display 168, timer display 170, and battery power level display 172.

The operation of ball toss apparatus 50 will now be discussed with reference to FIGS. 1–6. Prior to the launch of a volleyball using ball toss apparatus 50, there are numerous operations which must be completed to ensure a proper launch. First, a position for power switch 160 must be selected. Power switch 160 has three options: a bottom position which corresponds to having apparatus 50 powered on with no audible indicators (buzzer), a middle position having no power going from battery 110, and a top position having apparatus 50 powered on with the pre-launch buzzer activated.

With power switch 160 positioned in one of the two powered on states, mode switch 162 can then be set in one of three positions. First, a bottom position corresponding to the timer position which allows apparatus 50 to operate in conjunction with a timer located in CPU 156. In this position, a count down occurs and the ball is launched when the timer reaches zero. Second, a middle position which corresponds to a reset/adjust mode is used to "reset" apparatus 50 and to adjust the internal timer. Third, a top position corresponds to a remote mode which allows apparatus 50 to be controlled via remote control 158. In one preferred embodiment, remote control 158 is a battery powered, wireless, hand-held, radio frequency remote control having a receiver attached to circuit board 154. Power switch 160 is a transparent switch having an LED positioned underneath such that CPU 156 activates the LED when apparatus 50 is powered on. Mode switch 162 is also a transparent switch having an LED positioned underneath such that CPU 156 activates when a mode selection is made; i.e. remote mode or timer mode.

Height adjustment knob 164 controls how high and how fast a volleyball will be launched from apparatus 50. More specifically, height adjustment knob 164 interacts with pressure regulator 124 to adjust the amount of pressure which will be provided to pneumatic air cylinder 90 via storage tanks 116 and 118. The higher the setting of height adjustment knob 164, the faster and higher the volleyball will be launched. Height adjustment display 168 provides a LED bar display of the height chosen.

Timer adjustment knob 166 provides for adjustment in seconds of the amount of time before a ball will be launched. Timer display 170 is a two position digital display that displays the timer in seconds. It also indicates "low" and "high" height settings if the height via pressure regulator 124 is set too high or too low. The digital display will also show "---" when remote control 158 is in use rather than the timer.

Battery power level display 172 displays the amount of power remaining in the system. Battery power level display 172 comprises three colour LEDs (green, yellow, and red) indicating the level of battery 110. CPU 156 will not permit fall discharge of battery 110. Rather, CPU 156 will shut the system down (i.e. sleep mode) to prolong the life of battery 110 if battery 110 falls below a predetermined level below 10 volts.

CPU 156 provides three operational states of ball toss apparatus 50. First, there is a timed state in which ball toss apparatus 50 will automatically launch a volleyball at regular timed intervals. Second, there is an adjust state in which no launches are performed, but inputs and indicators are active. Features of apparatus 50 can be adjusted via control panel 80 in this state. Third, a manual state provides that the initiation of a launch sequence is triggered by remote control 158.

In addition to the three operational states described above, CPU 156 also provides four non-operational states. First, a sleep state provides that no outputs are on, however, CPU 156 is monitoring inputs. Apparatus 50 will enter the sleep state if apparatus 50 has not been used, i.e., there has been no launches or modification of inputs, for a significant period of time. In one preferred embodiment, apparatus 50 enters a sleep mode after 15 minutes of non-use. Second, a standby state provides that air compressor 120 may run if required, however, all other outputs are off. Third, a fault state provides that no launches are allowed. This state will be entered if CPU 156 recognizes that any one of a number of criteria are not met. For example, if optical sensor 121 does not indicated that a volleyball is properly positioned above launch arm 86, the system will be placed into a fault state via CPU 156. Fourth, an unknown state indicates that the proper operating modes have not been determined.

A single launch sequence will now be discussed with specific reference to FIGS. 5 and 6. In order to initiate a launch, power switch 160 must be positioned in either of the on positions (buzzer on or buzzer off). Mode switch 162 must also be properly positioned to either the timer or remote positions. Upon selecting the desired mode, optical sensor 121 senses if a ball is properly located above launch arm 86 and relays this information to CPU 156. If no ball is present, CPU communicates with three-way solenoid actuated valve 132 which activates pneumatic air cylinder 64 and a ball will be fed as previously described with relation to ball feeder mechanism 62. The angle of ball toss apparatus 50 can be adjusted via crank 74 and height adjustment knob 164 can be adjusted to ensure the proper height of the launch.

Once the system is powered on, compressor 120 will fill main air storage tank 116. Pressure regulator 124 will regulate the pressure to secondary air storage tank 118 via height adjustment knob 164. In one preferred embodiment, the pressure in main air storage tank 116 is maintained between 100 and 120 psi, regulator 124 regulates the pressure in secondary storage tank 118 between 10 and 100 psi. Height adjust knob 164 adjusts the pressure in secondary storage tank 118, which is the pressure used to launch a volleyball.

The air within secondary air storage tank 118 will be provided to pneumatic air cylinder 90 via three-way solenoid actuated valve 130. Pneumatic air cylinder 90 will force launch arm 86 to rotate as previously described with reference to FIGS. 2A and 2B, there by launching the volleyball.

Once the launch has been completed, CPU 156 actuates three-way solenoid actuated valve 132 to direct a predetermined amount of air in the range of 10 to 50 psi to pneumatic air cylinder 64 from main air storage tank 116 via regulator 128. This in turn forces ball feeder mechanism 62 to pivot as described with reference to FIG. 3, thereby allowing another volleyball to be positioned within housing 52 above launch arm 86.

As shown in FIG. 5, several elements such as optical sensor 121, pressure regulators 124 and 128, pressure switch 126 and three-way solenoid actuated valves 130 and 132 have electrical wiring exiting each element. This electrical wiring for each element is connected to circuit board 154. However, these connections have been eliminated from FIG. 5 for clarity reasons. In addition, while remote control transmitter 158 is a wireless component, it is understood that the remote control has a receiver located on or electrically connected to circuit board 154.

Although the present invention has been described with reference to preferred embodiments, workers skilled in the art will recognize that changes may be made in form and detail without departing from the spirit and scope of the invention.

We claim:

1. A ball toss apparatus for tossing a ball at a selectable speed, the ball toss apparatus comprising:

an air compressor for compressing air;

a main air storage tank connected to the air compressor for storing the compressed air;

a launch air storage tank;

a variable pressure regulator connected between the main air storage tank and the launch air storage tank, and responsive to a user input which selects a speed at which the ball is launched for variably regulating the pressure of the compressed air contained in the launch air storage tank so that the pressure of the compressed air in the launch air storage tank determines the speed at which the ball is launched;

a valve connected to the launch air storage tank;

a pneumatic cylinder connected to the launch air storage tank via the valve for receiving the variably regulated compressed air when the valve is actuated to launch the ball; and a ball launch arm connected to the pneumatic cylinder for launching the ball at the speed selected, wherein the pneumatic cylinder moves the arm when the valve is actuated to launch the ball at a speed which is a function of the pressure of the compressed air received by the pneumatic cylinder from the launch air storage tank.

2. The ball toss apparatus of claim 1 and further comprising:

an energy source for powering the air compressor.

3. The ball toss apparatus of claim 2 and further comprising:

a computer processing unit powered by the energy source and connected to the valve, for controlling the launch of the ball.

4. The ball toss apparatus of claim 3 and further comprising:

an optical sensor connected to the computer processing unit for detecting a ball positioned on the ball launch arm.

5. The ball toss apparatus of claim 3 and further comprising:

a remote control transmitter having a launch button for transmitting a launch signal; and a remote control receiver connected to the computer processing unit for receiving the launch signal.

6. The ball toss apparatus of claim 3 and further comprising:

a pre-launch buzzer connected to the computer processing unit for providing an audible signal prior to the launching of the ball.

7. The ball toss apparatus of claim 3 and further comprising:

a pre-launch light emitting diode connected to the computer processing unit for providing a visual signal prior to the launching of the ball.

8. The ball toss apparatus of claim 1 and further comprising:

a ball feeder for permitting a plurality of balls to be continuously positioned on the ball launch arm, the ball feeder further comprising:

a ball container for containing the plurality of balls;

a ball feeder mechanism for holding a ball adjacent to the ball launch arm and for permitting a ball to be positioned on the ball launch arm;

a second pneumatic cylinder connected to the ball feeder mechanism;

a second pressure regulator connected to the main air storage tank; and a second valve connected between the second pneumatic cylinder and the second pressure regulator.

9. The ball toss apparatus of claim 2 wherein the energy source further comprises:

a direct current battery; and a battery charger.

10. The ball toss apparatus of claim 1 wherein the variable air pressure regulator regulates the pressure in the launch air storage tank between 10 and 100 psi as a function of the speed selected.

11. The ball toss apparatus of claim 1 and further comprising:

a pressure switch connected to the main air storage tank for maintaining the compressed air in the main air storage tank.

12. The ball toss apparatus of claim 11 wherein the pressure switch maintains a maximum amount of compressed air in the main air storage tank between 100 and 120 psi.

13. The ball toss apparatus of claim 1 and further comprising:

a shock absorbing mechanism connected to the ball launch arm for minimizing vibration of the ball toss apparatus during the launching of the ball.

14. The ball toss apparatus of claim 13 wherein the shock absorbing mechanism further comprises:

a brace pivotally connected to a first end of the pneumatic air cylinder;

a bar wherein a second end of the pneumatic cylinder and the ball launch arm are pivotally connected to the bar; and a spring connected to the bar and to the brace.

15. The ball toss apparatus of claim 1 and further comprising:

an angle adjustment mechanism for adjusting an angle of the ball toss apparatus, thereby adjusting an angle at which the ball is launched.

16. The ball toss apparatus of claim 3 and further comprising:

a timer connected to the computer processing unit for permitting the launch of the ball after a predetermined length of time.

17. The ball toss apparatus of claim 3 and further comprising:

a control panel connected to the computer processing unit to supply inputs for controlling various features of the apparatus.

18. The ball toss apparatus of claim 17 wherein the control panel comprises:

a power mechanism for permitting power from the energy source to other elements of the apparatus;

a mode select input for permitting the apparatus to operate in a plurality of modes;

a timer adjustment input for adjusting an amount of time prior to a launch of the ball; and a battery life indicator.

* * * * *